US012202584B2

(12) United States Patent
Webb

(10) Patent No.: US 12,202,584 B2
(45) Date of Patent: Jan. 21, 2025

(54) DETACHABLE OAR PROPULSION IMPLEMENT

(71) Applicant: Jon Webb, Draper, UT (US)

(72) Inventor: Jon Webb, Draper, UT (US)

( * ) Notice: Subject to any disclaimer, the term of this patent is extended or adjusted under 35 U.S.C. 154(b) by 416 days.

(21) Appl. No.: 17/511,147

(22) Filed: Oct. 26, 2021

(65) Prior Publication Data

US 2023/0127305 A1 Apr. 27, 2023

(51) Int. Cl.

| | |
|---|---|
| ***B63H 1/20*** | (2006.01) |
| ***B63B 32/10*** | (2020.01) |
| ***B63H 16/04*** | (2006.01) |
| ***B63H 21/17*** | (2006.01) |
| ***B63H 21/21*** | (2006.01) |

(52) U.S. Cl.

CPC ..... *B63H 1/20* (2013.01); *B63B 32/10* (2020.02); *B63H 16/04* (2013.01); *B63H 21/17* (2013.01); *B63H 21/213* (2013.01); *B63H 2021/216* (2013.01)

(58) Field of Classification Search

CPC ..... B63H 1/20; B63H 5/07; B63H 2005/075; B63H 21/17; B63H 21/213; B63H 2021/216; B63H 16/00; B63H 16/04

USPC ..... 440/6, 101

See application file for complete search history.

(56) References Cited

U.S. PATENT DOCUMENTS

| | | | | |
|---|---|---|---|---|
| 1,512,391 A * | 10/1924 | Abraham | B63H 25/42 | 416/70 R |
| 3,498,253 A * | 3/1970 | Wood, Jr. | B63H 20/007 | 416/69 |
| 5,908,339 A * | 6/1999 | Vassoff | B63H 5/14 | 440/49 |
| 8,512,086 B1 * | 8/2013 | Charczuk | B63H 25/42 | 416/74 |
| 9,352,816 B1 * | 5/2016 | Sawyer, Jr. | B63H 16/04 | |

* cited by examiner

*Primary Examiner* — Daniel V Venne

(74) *Attorney, Agent, or Firm* — Steven Rinehart

(57) ABSTRACT

A handheld, detachable implement for propelling a paddleboard which affixed to a distal end of an oar, the implement comprising a propeller, motor and power supply. The oar and propulsion implement may be formed as a single integrated piece or held together using a friction fit. A plurality of sensor and indicator integrate into the implement.

17 Claims, 5 Drawing Sheets

DETACHABLE OAR PROPULSION IMPLEMENT

FIELD OF THE INVENTION

This invention relates to watersports, and more particularly related to a battery-powered detachable propulsions system for oars and paddleboards.

BACKGROUND

Description of the Related Art

Paddleboards have become a popular form of recreation. Typically, a rower stands in an upright position on the paddleboard and moves the paddleboard across the surface of water using an oar. Leg and arm strength are required to keep upright and row on the paddleboard without capsizing for extended periods of time. The typical paddleboard rower does not have the muscle strength to fight even light winds, which can rotate and push a paddleboard into deeper waters, creating safety hazards and inability on the part of the paddleboarder to return to shore. This can make use of paddleboards in windy conditions untenable.

Additionally, although many users participate in paddleboarding for fitness-related reasons, the typical paddleboarder does so only for recreational reasons and desires more effective way of steering and maneuvers on a paddleboard simply as a matter of enjoyment.

Pedal-powered paddleboards, and paddleboards with built-in rudder systems activated via a foot-manipulated lever, are known in the art, however they drastically increase the weight of the paddleboard and costs of manufacture. Rowers desiring this functionality are consequently left only with paddleboard and oar options which integrate the desired functionality. Additionally, as an integrated rudder system requires the rower to stay in a fixed standing position to manipulate the rudder, these designs prevent a rower from being able to move about the surface of the paddleboard.

There currently exists no solutions in the art which overcomes these inefficiencies. It is therefore an object of the present invention to provide a detachable propulsion system for oars which allows rowers to select an oar and paddleboard of choice and which imparts rudder and propulsion function without requiring a rower to remain in a fixed standing position.

SUMMARY

From the foregoing discussion, it should be apparent that a need exists for a detachable oar propulsion system. Beneficially, such a device would overcome inefficiencies with the prior art by providing an inexpensive, lightweight and efficient means propelling and steering a paddleboard. The present invention has been developed in response to the present state of the art, and in particular, in response to the problems and needs in the art that have not yet been fully solved by currently available apparti. Accordingly, the present invention has been developed to provide a detachable oar propulsion implement, the implement comprising: a tubular housing defining a hollow interior recess, the housing having an open rearward end for expelling ambient water; a propeller disposed centrically within the open rearward end, the propeller adapted to rotate axially and propel water inflowing into the housing from the open rearward end; wherein the housing defines two or more vents forward of the propeller adapted to intake ambient water into a recess in which the propeller is disposed; a top plate affixed superiorly to the tubular housing, the top plate adapted to contour an exterior surface of an oar, the top plate defining a plurality of slots traversing the top plate; an electric motor adapted to drive the propeller; a driveshaft interconnecting the electric motor and propeller; a power supply; a switch in electrical connectivity with the power supply and electric motor adapted to power on the electric motor and propeller; wherein the elongated plate comprises a planar top surface and planar bottom surface.

The housing may be one of conical and frustoconical.

The power supply may comprise a lithium-ion battery which may be from 7.4 volts to 48 volts.

A transom may position within the hollow interior recess dividing the hollow interior recess into two sub-recesses, including a forward recess adapted to receive electrical, mechanical and electromechanical components; and a rearward cavity in which the propeller disposes.

The oar propulsion apparatus may further comprise a plurality of LED indicators, each indicating a binary state of an electrical system of the apparatus, including one of power, forward propulsion, reverse propulsion, and battery power state. The LED indicators may further indicate a temperature of the surrounding ambient air or water, a depth of the surrounding water using a pressure transducer, and may also comprise an LED for illuminating water beneath the water's surface in some embodiments.

The top plate and tubular component may be formed as a single integrated piece.

The oar propulsion apparatus may further comprise a strap adapted to circumscribe an oar, the strap threaded through two or more of the plurality of slots. In various embodiments, the sleeve or housing contoured to envelope the oar propulsion apparatus and oar is slidably affixed over the oar and oar propulsion apparatus, forming a friction fit therewith.

The top plate may define four or more slots.

A top surface of the top plate may be one of planar and slightly concave.

The oar propulsion apparatus may further comprise a USB port adapted to charge the power supply.

In various embodiments, the oar propulsion apparatus further comprises a plurality of LED indicator lights, each LED indicator light exclusively associated with an electrical status of the apparatus.

The oar propulsion apparatus may further comprise a switch external to the housing adapted to power the motor on and off. The oar propulsion apparatus may further comprise a plurality of depressible controls.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention may be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
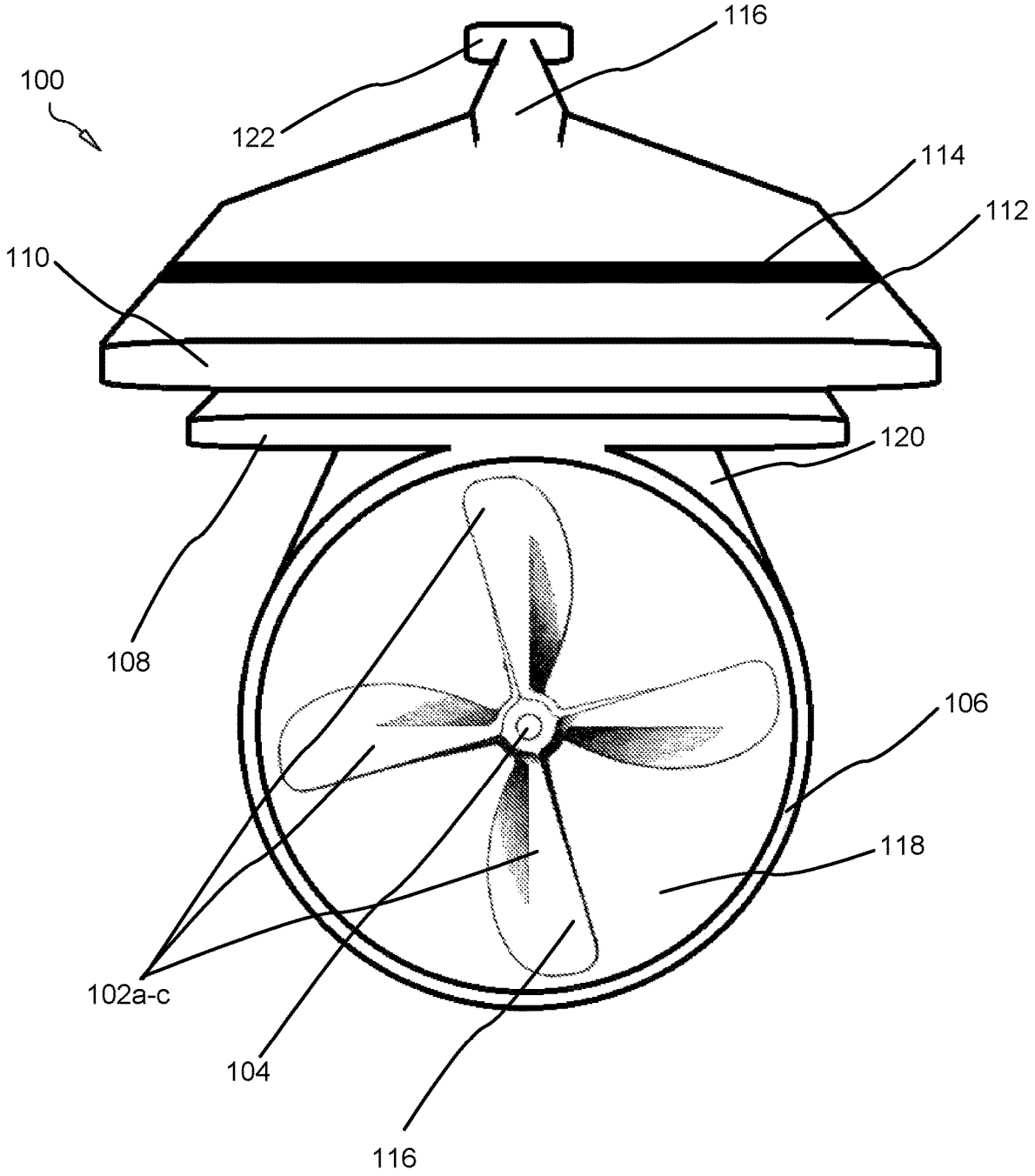
FIG. 1 is a rearward perspective view of a detachable oar propulsion implement in accordance with the present invention.
Figure 2:
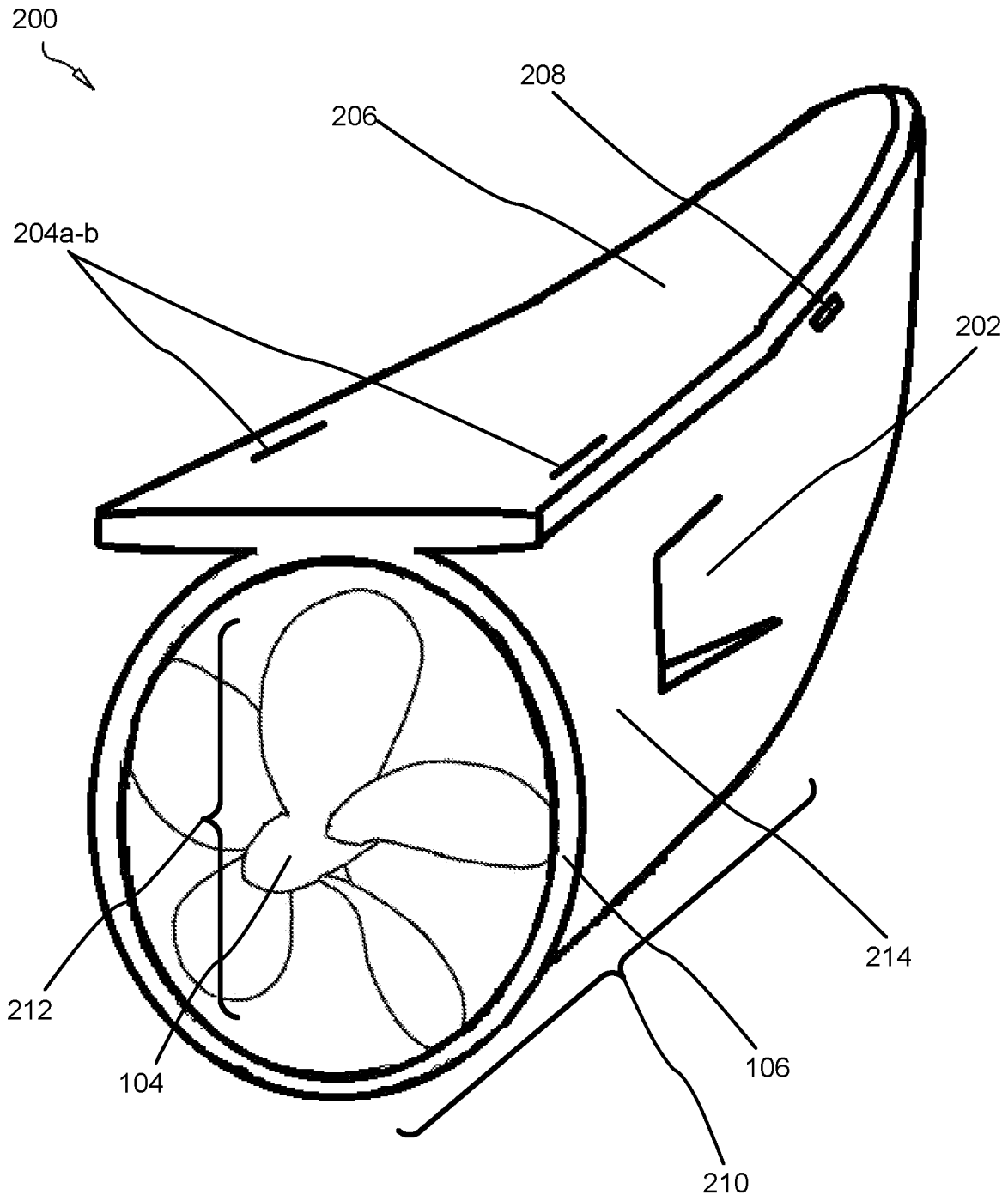
FIG. 2 is a rear-side perspective view of a detachable oar propulsion implement in accordance with the present invention.
Figure 3:
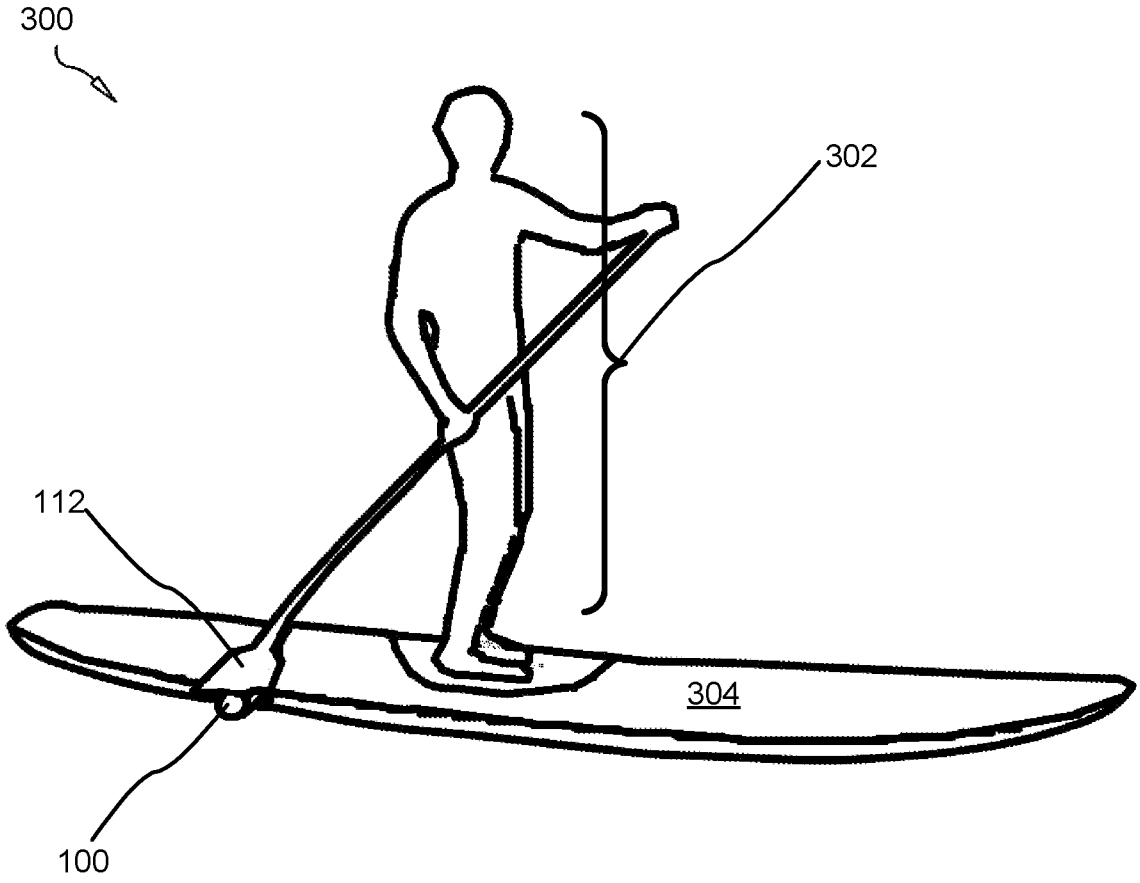
FIG. 3 is an environmental, perspective view of a detachable oar propulsion implement in accordance with the present invention.

FIGS. 1-3 illustrate perspective views of a detachable oar propulsion implement 100 in accordance with the present invention.

The apparatus 100 comprises a propeller 116 which rotates about a central axis point 104 having a plurality of blades 102. The propeller 116 is disposed within an open rearward end 212 of a housing 210. In some embodiments, the propeller is disposed centrally within the open rearward end 212. In alternative embodiments, the apparatus 100 comprises a jet in place of a propeller 116, which jet may incorporate a water or jet pump and be adapted to force a high-velocity stream of water from the open rearward end 212 (e.g. nozzle 212).

The housing 210 comprises a metallic or polymeric shell adapted to receive the majority of the mechanical and electrical components operable to impart function to the apparatus 100. The housing 102 may be formed from a tubular component 120 defining a hollow interior recess adapted to receive a plurality of electrical and mechanical components separated from the cavity 118 in which the propeller 116 is disposed by a transom 412.

The tubular component 120 may be arcuate as shown, and rise upwardly to meet a planar top plate 108 to which the tubular component 120 is affixed. The planar top plate 108 may be formed with the tubular component as a single integrated piece through means know to those of skill in the art, including die cast, additive manufacturing, and the like.

In various embodiments, the housing 102 is bifurcated along a horizontal and/or vertical plane such that the housing 102 separates into multiple components, facilitating repair and/or installation of internal components.

The cavity 118 in which the propeller 116 positions is open to the ambient water at the open rearward end 212 and at two forward vents 212 positioned laterally on either side of the housing 102. These open forward vents 212 function as water inlets, directing ambient water into the cavity 118 when the apparatus 100 is in forward motion.

The planar top plate 108 comprises a top surface which is either planar or slightly concave and contoured to engage an external surface of the paddle 110 of an oar 112. The top plate 108 defines two slots 204, or apertures, adapted to receive the strap 114. The strap 114 partially circumscribes the oar 112. The apparatus 100 may comprise four, six or more slots 204.

The apparatus may comprise a USB port 208 for charging a power supply 402 within the apparatus 100. The USB port may be one of a mini-USB, USB type C, a micro-USB, and the like.

The apparatus 100 may be configured to mate with an external surface of the oar 112 using a strap 114 or other fastening mechanisms, including, exemplarily, clamps, brackets, screws, bolts, or the like.

The apparatus 100, 200 is used on an oar 112 as shown in FIG. 3 by a rower 302 to propel, steer, and maneuver a paddleboard 304.

Figure 4:
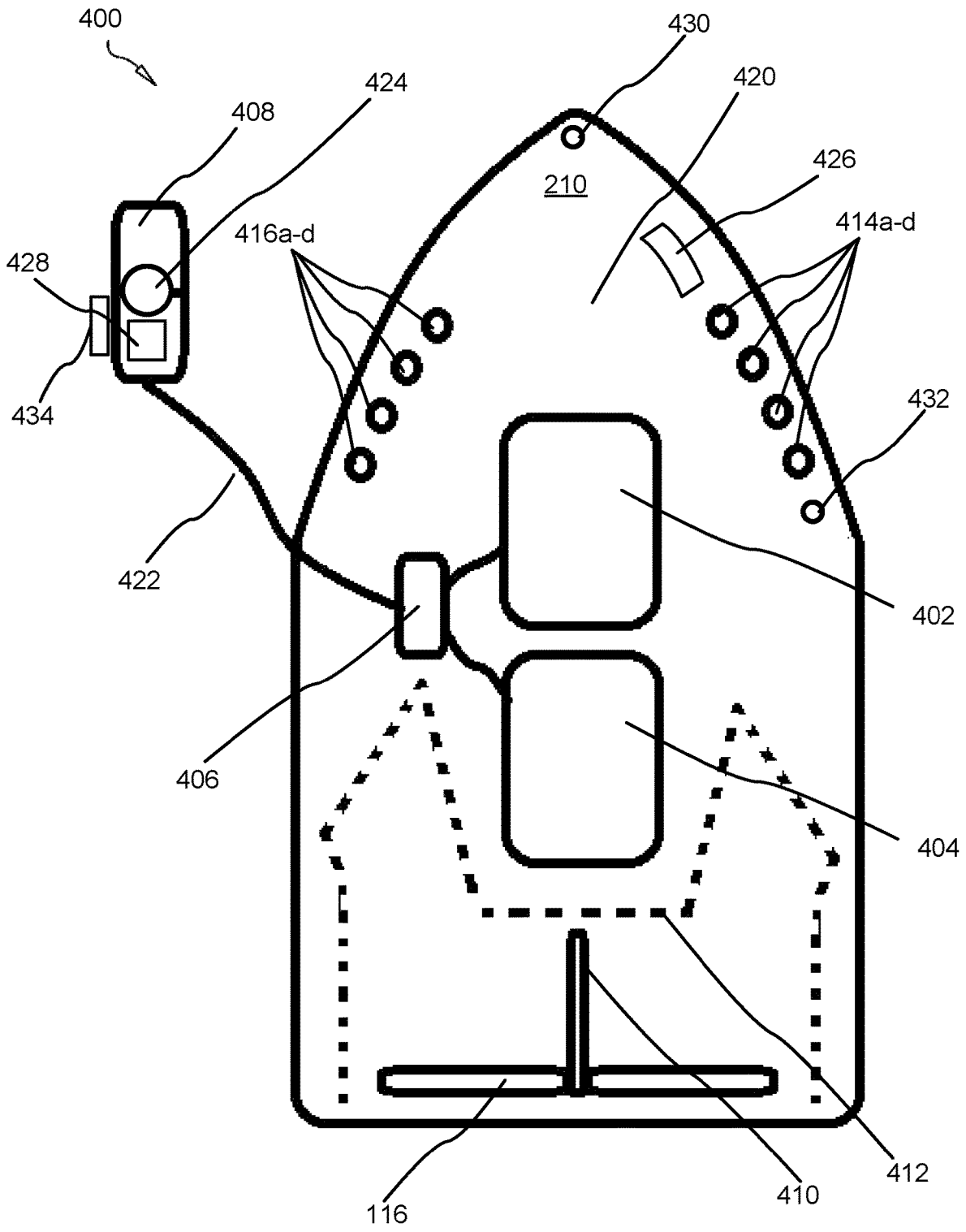
FIG. 4 is a sectioned, top perspective view of a detachable oar propulsion implement in accordance with the present invention.

FIG. 4 is a sectioned, top perspective view of a detachable oar propulsion implement in accordance with the present invention.

In various embodiments, the housing 102 defines a forward hollow cavity 420 adapted to receive the majority of the mechanical and electrical components of the apparatus 100, 400, including a motor 404 interconnected with the propeller 116 using a drive shaft 410, and the power supply 402, which may comprise a 7.4 volt lithium-ion battery. The lithium ion battery may alternatively be from 7.4 volts to 18 volts, or even to 48 volts.

A switch 408 external to the housing 102 may be depressed or manually activated to power on the motor 404. In various embodiments, the switch 408 may be activated to reverse propulsion of the apparatus 100, 400. The switch 408 is connected using wires 422 incorporating the switch 408 into the circuit. A separate switch 406 closes the circuit in response to activation of the switch 408. In some embodiments, the switch 408 is in wireless connectivity with the motor 404 over a LAN (local area network) using means known to those of skill in the art.

In various embodiments, the apparatus 400 comprises a variable potentiometer twist knob 424 for speed adjustment of the propeller between 0 and 100% power, imparting adjustable speed function the apparatus 400.

A plurality of LED indicator lights 414 may position around, within, or on the housing 102. The LED indicator lights 414 may each be adapted to exclusively indicate operation of an electrical or electromechanical status of the apparatus, such as power (on or off), reverse, wireless connectivity, or battery power. The status indicated by the LED indicator lights 414 may be binary, either on or off. The LED indicators 414 may also indicate In various embodiments, the apparatus 400 also comprises a thermometer 432. The temperature of the ambient water or air may be displayed on the display 428.

In various embodiments, the apparatus 400 further comprises an LED light 430 adapted to illuminate the water below the water surface and/or surrounding above the water surface. The LED light 430 may be activated using a switch 434.

In some embodiments, the apparatus 400 comprises a pressure transducer 426 which may measure pressure and indicate a depth on a digital display 428.

Likewise, a plurality of depressible or otherwise tactilely-activated controls 416 position on the housing 102. The function of these controls may be duplicative of the function of the switch 408, or alternate, such as power on, reverse, and the like.

A transom 412 separates the cavity 420 from the cavity 118.

Figure 5:
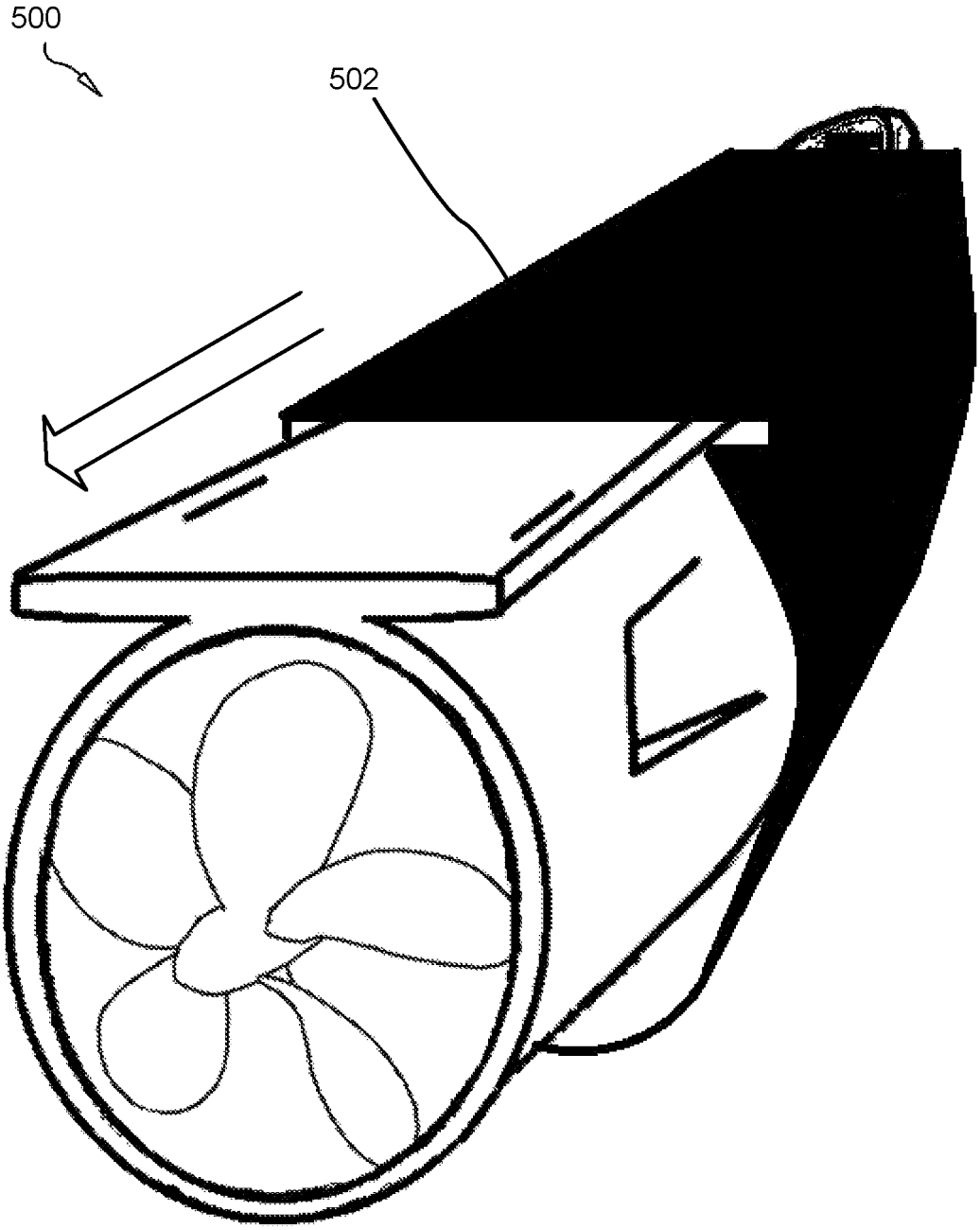
FIG. 5 is an isometric perspective view of a detachable oar propulsion implement in accordance with the present invention.

FIG. 5 is an isometric perspective view of a detachable oar propulsion implement 500 in accordance with the present invention.

The oar propulsion apparatus/implement 500 may further comprise a polymeric sleeve 502 adapted to contour the oar and apparatus, slidably affixable in place, which forms a friction fit with the oar and apparatus and holds the apparatus in place in abutment with the oar.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A detachable oar propulsion apparatus, the apparatus comprising:

a tubular housing defining a hollow interior recess, the tubular housing having an open rearward end for expelling ambient water;

a propeller disposed centrically within the open rearward end, the propeller adapted to rotate axially and propel water inflowing into the tubular housing from the open rearward end;

wherein the tubular housing defines two or more vents forward of the propeller adapted to intake ambient water into a recess in which the propeller is disposed;

a top plate affixed superiorly to the tubular housing, the top plate adapted to contour an exterior surface of an oar, the top plate defining a plurality of slots traversing the top plate;

an electric motor adapted to drive the propeller;

a driveshaft interconnecting the electric motor and propeller;

a power supply; and a switch in electrical connectivity with the power supply and electric motor adapted to power on the electric motor and propeller.

2. The detachable oar detachable propulsion apparatus of claim 1, wherein the tubular housing is one of conical and frustoconical.

3. The detachable oar propulsion apparatus of claim 1, wherein the power supply comprises a 7.4 volt lithium-ion battery.

4. The detachable oar propulsion apparatus of claim 1, wherein the power supply is between 7.4 and 18 volts.

5. The detachable oar propulsion apparatus of claim 1, operable to impart speed function adjustment to the detachable oar propulsion apparatus.

6. The detachable oar propulsion apparatus of claim 1, wherein a transom divides the hollow interior recess into a forward recess adapted to receive electrical, mechanical and electromechanical components; and a rearward recess.

7. The detachable oar propulsion apparatus of claim 1, further comprising a plurality of LED indicators, each indicating a binary state of an electrical system of the oar propulsions apparatus, including one of power, forward propulsion, reverse propulsion, and battery power state.

8. The detachable oar propulsion apparatus of claim 1, wherein the top plate and tubular housing are formed as a single integrated piece.

9. The detachable oar propulsion apparatus of claim 1, further comprising a strap adapted to circumscribe an oar, the strap threaded through two or more of the plurality of slots.

10. The detachable oar propulsion apparatus of claim 1, wherein the top plate defines four or more slots.

11. The detachable oar propulsion apparatus of claim 1, wherein a top surface of the top plate is one of planar and slightly concave.

12. The detachable oar propulsion apparatus of claim 1, further comprising a USB port adapted to charge the power supply.

13. The detachable oar propulsion apparatus of claim 1, further comprising a plurality of LED indicator lights, each LED indicator light exclusively associated with an electrical status of the detachable oar propulsion apparatus.

14. The detachable oar propulsion apparatus of claim 1, further comprising a switch external to the housing adapted to power a motor on and off connected to the propeller.

15. The detachable oar propulsion apparatus of claim 1, further comprising a plurality of depressible controls.

16. The detachable oar propulsion apparatus of claim 1, further comprising one or more of a thermometer, an LED light adapted to illuminate surroundings, and a pressure transducer.

17. The detachable oar propulsion apparatus of claim 1, further comprising a polymeric sleeve adapted to contour the oar, slidably affixable in place, which forms a friction fit with the oar and holds the detachable oar propulsion apparatus in place in abutment with an oar.

* * * * *